US007708357B2

(12) United States Patent
Cho

(10) Patent No.: US 7,708,357 B2
(45) Date of Patent: May 4, 2010

(54) AUTOMATIC LOCKING APPARATUS USED IN GUIDE RAIL FOR DRAWER

(76) Inventor: Weon-Dong Cho, 4, Annex B/D of the Dong-nam Management Corporation, 851-1, Oe-dong, Changwon-city, Gyeongsangnam-do, 641-020 (KR)

( * ) Notice: Subject to any disclaimer, the term of this patent is extended or adjusted under 35 U.S.C. 154(b) by 294 days.

(21) Appl. No.: 11/725,729

(22) Filed: Mar. 20, 2007

(65) Prior Publication Data

US 2008/0231153 A1 Sep. 25, 2008

(51) Int. Cl.
*A47B 95/00* (2006.01)

(52) U.S. Cl. ..... 312/333

(58) Field of Classification Search ..... 312/333, 312/334.7, 334.8, 334.44, 334.46, 334.47; 384/21

See application file for complete search history.

(56) References Cited

U.S. PATENT DOCUMENTS 3,328,106 A * 6/1967 Mullin ..... 312/334.7
5,433,517 A * 7/1995 Fleisch ..... 312/334.8
5,757,109 A * 5/1998 Parvin ..... 312/334.11
6,224,177 B1 * 5/2001 Chu ..... 312/334.1
6,254,205 B1 * 7/2001 Wright et al. ..... 312/217
6,497,464 B1 * 12/2002 Cammack et al. ..... 312/333
7,101,081 B2 * 9/2006 Chen et al. ..... 384/21
2005/0218760 A1 * 10/2005 Cheng ..... 312/333

* cited by examiner

*Primary Examiner*—Janet M Wilkens
*Assistant Examiner*—Dan Rohrhoff
(74) *Attorney, Agent, or Firm*—Greer, Burns & Crain, Ltd.

(57) ABSTRACT

Disclosed is an automatic locking apparatus used in a guide rail for a drawer. The automatic locking apparatus is provided at an end portion of a fixing slider to lock a movable slider when the drawer is closed. The automatic locking apparatus prevents the drawer from being opened and smoothly locks the drawer. A stopper ring is attached to the movable slider, and the automatic locking apparatus is provided on the fixing slider to cooperate with the stopper ring. The automatic locking apparatus includes a fixing plate attached to the fixing slider, a body fixed to the fixing plate while protruding toward the movable slider, an elastic member having a substantially "C" shape and being rotatably coupled to one end of the body, and a rotating member having a substantially "reverse-L" shape and being rotatably coupled to the other end of the body.

3 Claims, 7 Drawing Sheets

"PRIOR ART"

"PRIOR ART"

"PRIOR ART"

"PRIOR ART"

AUTOMATIC LOCKING APPARATUS USED IN GUIDE RAIL FOR DRAWER

BACKGROUND OF THE INVENTION

1. Field of the Invention

The present invention relates to a guide rail for a drawer. More particularly, the present invention relates to an automatic locking apparatus used in a guide rail for a drawer, in which the automatic locking apparatus can slidably lock the drawer on the guide rail even if a user touches the drawer with little force.

2. Description of the Related Art

In general, a drawer is installed in a cabinet, a desk, and the like so as to allow a user to store various materials, such as personal things, documents and various office supplies, in the drawer according to applications thereof. Such a drawer slidably moves along a guide rail including fixing sliders attached to both inner side surfaces of a drawer receiving section, and movable sliders attached to both outer side surfaces of the drawer.

In detail, as shown in FIG. 1, a conventional guide rail 1 includes a fixing slider 10 and a movable slider 20, in which at least one coupling hole 11 is formed in the fixing slider 10 such that the fixing slider 10 can be coupled with a side surface of a drawer receiving section A (see, FIG. 2) by means of a bolt and a screw, a first stopper 13 is provided at one end of a recess section 12 of the fixing slider 10 so as to limit the movement of the drawer, and a first convey slot 14 having a predetermined depth is formed on outer portions of upper and lower bending sections of the fixing slider 10, and in which the movable slider 20 has a size sufficient for receiving the fixing slider 10, second and third stoppers 23 and 24 are provided at both ends of a recess section 22 of the movable slider 20 so as to limit the movement of the drawer, a second convey slot 25 having a predetermined depth, which is corresponding to the first convey slot 14 of the fixing slider 10, is formed on inner portions of upper and lower bending sections of the movable slider 20, and a plurality of screw holes 21 are formed at the bottom of the recess section 22 of the movable slider 20 so as to couple the movable slider 20 with the drawer B (see, FIG. 2) while supporting the drawer.

In addition, as shown in FIG. 2, when the fixing slider 10 is accommodated in the movable slider 20, the upper and lower bending sections of the fixing slider 10 are spaced apart from the upper and lower bending sections of the movable slider 20 by a predetermined distance, so that a roller bracket 30 equipped with at least one roller 31 can be provided between the fixing slider 10 and the movable slider 20.

In a state in which the guide rail 1 including the fixing slider 10 and the movable slider 20 makes contact with the side of the drawer B and the drawer receiving section A, if the user pulls or pushes the drawer to open or close the drawer, the drawer slidably moves smoothly according to the movement of the roller bracket 30 installed in the first and second convey slots 14 and 25.

That is, as shown in FIGS. 3 and 4, if the user pulls the drawer in a state in which the drawer has been accommodated in the drawer receiving section A, the roller bracket 30 and the movable slider 20 are slidably moved in the moving direction of the drawer along the first covey slot 14 of the fixing slider 10. At this time, if the drawer is fully pulled, both end portions of the roller bracket 30 make contact with the first and third stoppers 13 and 24, so that the movement of the drawer is restricted without separating the movable slider 20 and the roller bracket 30 from the fixing slider 10.

In addition, if the user pushes the drawer to close the drawer, the second stopper 23 makes contact with one end of the fixing slider 10, so that the movement of the drawer is restricted.

However, the drawer having the above structure represents problems when the user pushes or pulls the drawer close or open the drawer, especially, when the user pushes the drawer to close the drawer. That is, if the desk is inclined, the drawer may not be closed, but may be automatically opened due to the tare thereof.

In order to solve the above problem, a guide rail equipped with a locking device has been suggested. However, according to the guide rail equipped with the locking device, the user must push the drawer with strong force in order to lock the drawer, so that not only is noise generated, but also the drawer or the guide rail is broken when it is used for a long period of time.

SUMMARY OF THE INVENTION

The present invention has been made to solve the above problems occurring in the prior art, and an object of the present invention is to provide a guide rail equipped with an automatic locking apparatus provided at an end portion of a fixing slider and smoothly pulled back as it makes contact with a movable slider so as to receive the movable slider.

In order to accomplish the above object, the present invention provides an automatic locking apparatus used in a guide rail for a drawer, in which the guide rail includes fixing sliders attached to both inner side surfaces of a drawer receiving section, movable sliders attached to both outer side surfaces of the drawer so as to move along the fixing sliders, and a stopper ring provided at a front surface of an end portion of the movable slider, the automatic locking apparatus being provided at an end portion of the fixing slider so as to incorporate with the stopper ring, the automatic locking apparatus comprising: a fixing plate integrally formed at an upper surface of an end portion of the fixing slider; a body having a mounting member provided at an upper surface of the fixing plate while protruding toward the movable slider, in which the body has a substantially lozenge shape and is formed at a center thereof with a coupling hole so as to be coupled with the mounting member, first and second hinge grooves having semi-cylindrical shapes are formed at first and second end portions of the body, and the second hinge groove is positioned lower than the first hinge groove; an elastic member having a substantially "C" shape, in which first and second hinges are integrally formed at both side ends of the elastic member, and the first hinge is rotatably inserted into the first hinge groove so that the elastic member is rotatably coupled with the body; and a rotating member having a substantially "reverse-L" shape, in which a third hinge having a cylindrical shape corresponding to the second hinge groove is provided at one end of an upper portion of the rotating member, a third hinge groove corresponding to the second hinge is formed at a rear portion of the third hinge, the third hinge is rotatably inserted into the second hinge groove, the second hinge is inserted into the third hinge groove, and a locking recess making contact with the stopper ring is provided at a lower portion of the rotating member.

BRIEF DESCRIPTION OF THE DRAWINGS

The above and other advantages of the present invention will become readily apparent with reference to the following detailed description when considered in conjunction with the accompanying drawings wherein.

DESCRIPTION OF THE EMBODIMENTS

Hereinafter, an automatic locking apparatus used in a guide rail for a drawer according to an exemplary embodiment of the present invention will be explained in detail with reference to the accompanying drawings.

Figure 1:
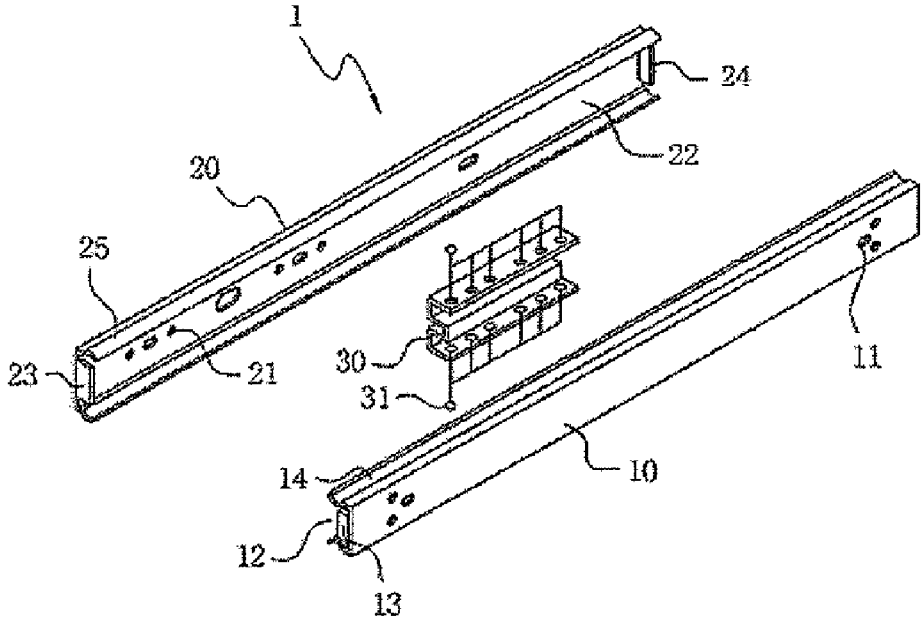
FIG. 1 is an exploded perspective view illustrating a conventional guide rail for a drawer.
Figure 2:
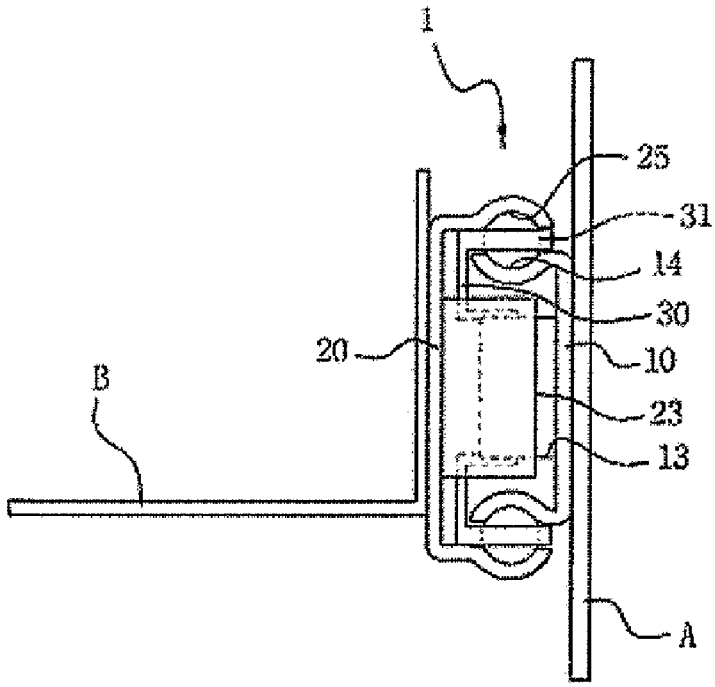
FIG. 2 is a side view of the guide rail shown in FIG. 1.
Figure 3:
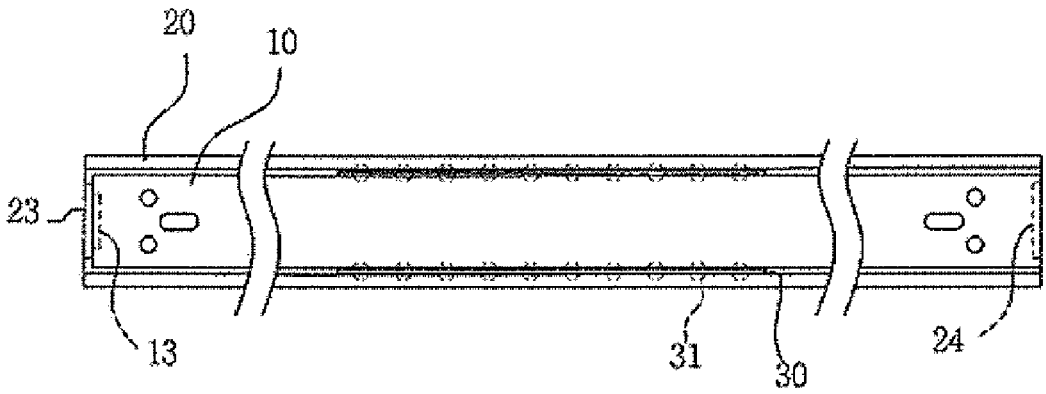
FIGS. 3 and 4 are views illustrating the operational state of the guide rail shown in FIG. 1.
Figure 4:
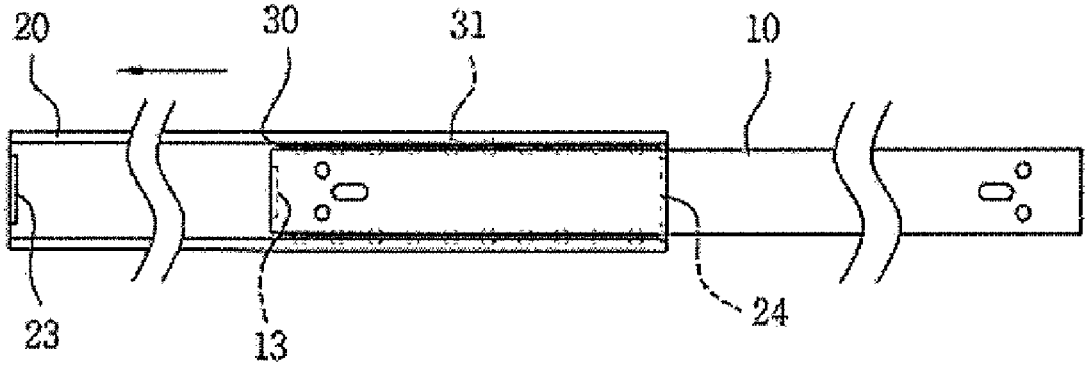
Figure 5:
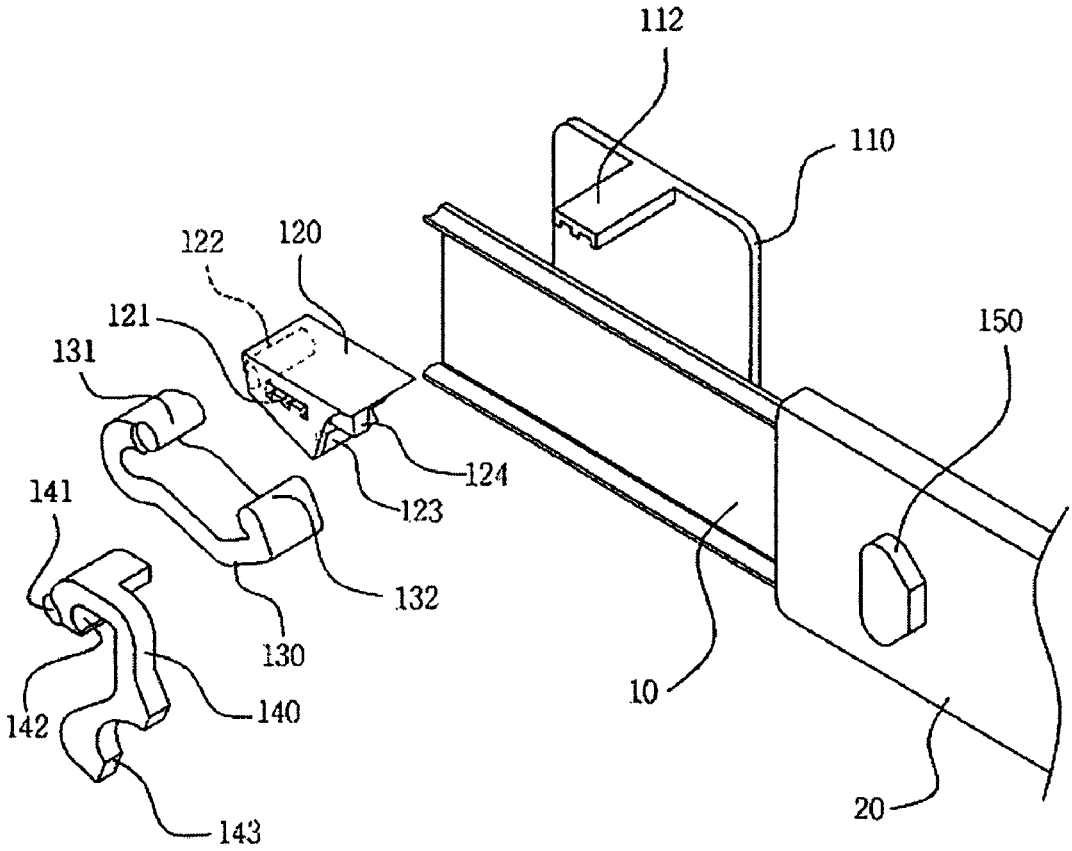
FIGS. 5 and 6 are an exploded perspective view and an assembled perspective view, respectively, illustrating an automatic locking apparatus used in a guide rail for a drawer according to an embodiment of the present invention.
Figure 6:
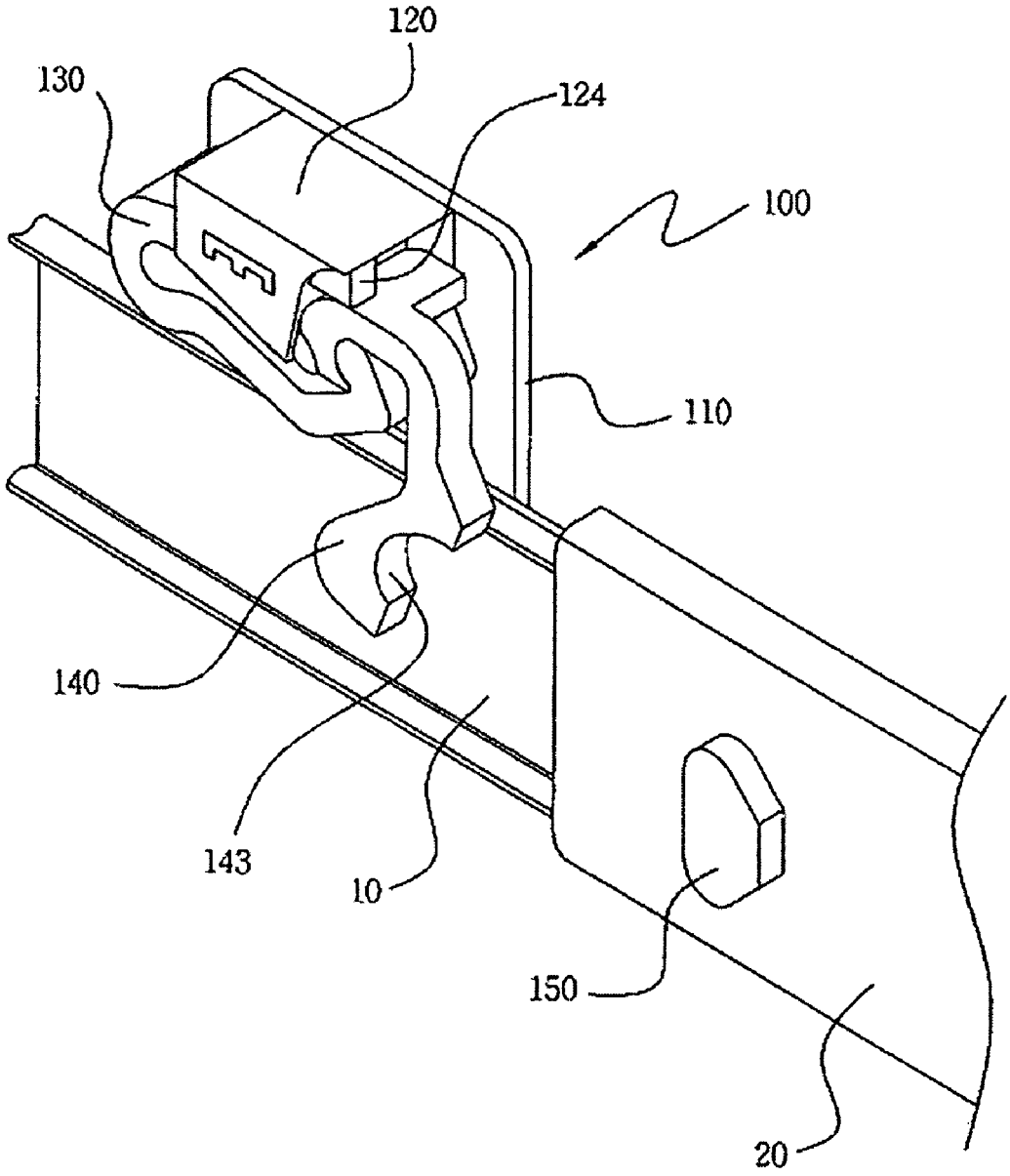

As shown in FIGS. 5 and 6, the present invention provides a guide rail including fixing sliders 10 (only one is shown for illustrative purposes) attached to both inner side surfaces of a drawer receiving section (not shown) and movable sliders 20 (only one is shown for illustrative purposes) attached to both outer side surfaces of a drawer (not shown) and slidably moved while overlapping with the fixing sliders 10. In addition, the present invention provides an automatic locking apparatus 100 installed at an end portion of the fixing sliders 10 so as to prevent the movable sliders 20 from moving backward.

The automatic locking apparatus 100 includes a fixing plate 110, a body 120, an elastic member 130, a rotating member 140, and a stopper ring 150.

The fixing plate 110 is attached to a rear side of the fixing slider 10. The fixing plate 110 extends higher than an upper surface of the movable slider 20. A mounting member 112, which protrudes toward the movable slider 20, is integrally formed with an upper end of the fixing plate 110.

The body 120 has a substantially rectangular shape or a lozenge shape and is fixed to a front surface of the fixing plate 110. That is, the body 120 is formed at front and rear portions thereof with coupling holes 121 so as to be fixedly coupled with the mounting member 112. First and second hinge grooves 122 and 123 having semi-cylindrical shapes are formed at one end and the other end of the body 120. Preferably, the second hinge groove 123 is positioned slightly below the first hinge groove 122.

The elastic member 130 has a substantially "C" shape. First and second hinges 131 and 132 having cylindrical shapes are integrally formed at both side ends of the elastic member 130, respectively. The first hinge 131 is rotatably inserted into the first hinge groove 122 of the body 120, so that the elastic member 130 is rotatably coupled with the body 120.

The rotating member 140 has a substantially "reverse-L" shape. An upper end portion of the rotating member 140 is inserted between the other side of the body 120 and the other side of the elastic member 130. Thus, if the rotating member 140 rotatably moves downward, the other side of the elastic member 130 is received in the rotating member 140, so that the rotating member 140 can be elastically moved. That is, a third hinge 141, which has a cylindrical shape corresponding to the second hinge groove 123 formed at the other side of the body 120, is integrally formed with an upper end portion of the rotating member 140, and the second hinge 132 formed at the other side of the elastic member 130 is rotatably inserted into a third hinge groove 142 formed at an inner portion of the rotating member 140 adjacent to the third hinge 141. Therefore, the third hinge 141 of the rotating member 140 is rotatably coupled with the second hinge groove 123 of the body 120, and the second hinge 132 of the elastic member 130 is rotatably coupled with the third hinge groove 142 of the rotating member 140. In addition, a locking recess 143 is provided at a lower end portion of the rotating member 140.

In addition, a spacer protrusion 124 is integrally formed at an upper portion of the second hinge groove 123 that makes contact with a front portion of the third hinge 141 so as to prevent the third hinge 141 from being fixedly installed in the second hinge groove 123. Due to the spacer protrusion 124, the rotating member 140 can return to its initial position even if little force is applied to the rotating member 140.

Figure 7:
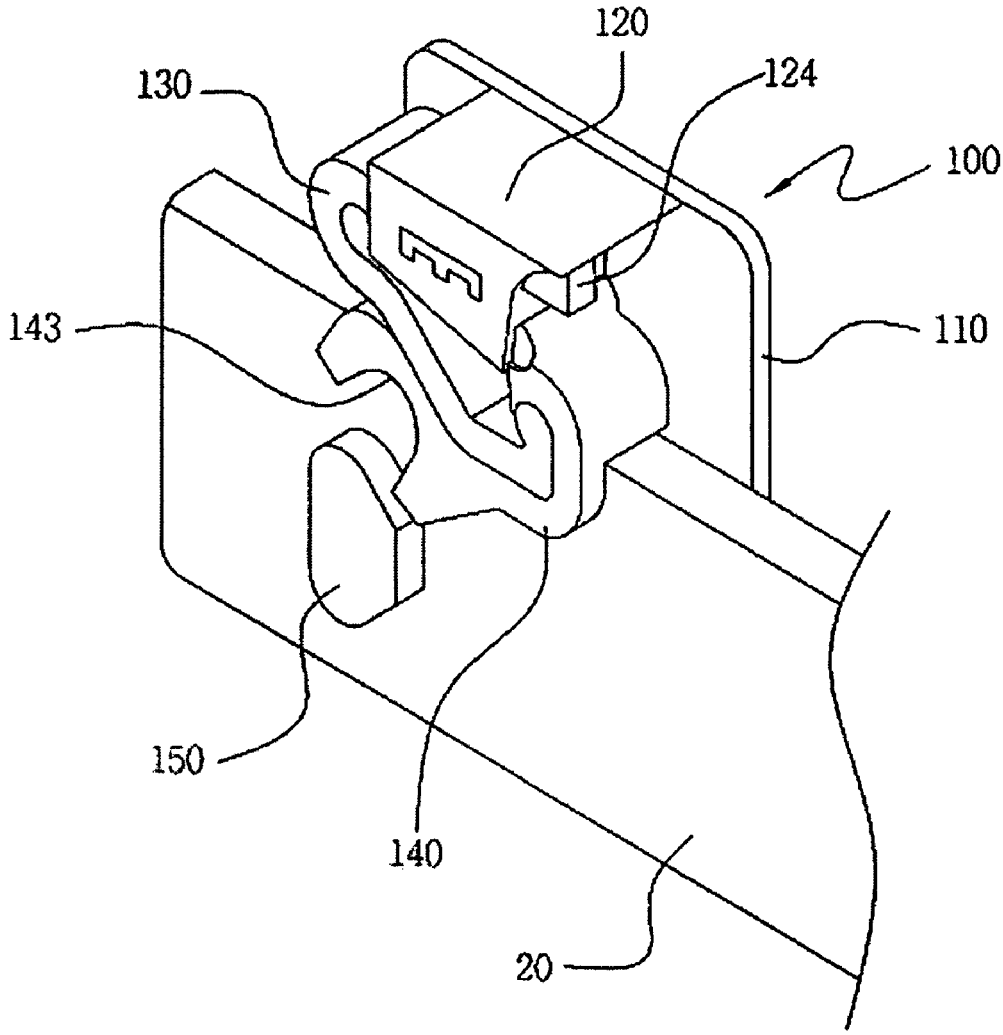
FIG. 7 is a perspective view illustrating a movable slider which is locked by means of an automatic locking apparatus.

The stopper ring 150 is attached to an end portion of the movable slider 20. The stopper ring 150 is made from a rubber material having a damping function. An upper portion of the stopper ring 150 makes contact with the locking recess 143 provided at the lower end portion of the rotating member 140. That is, as shown in FIG. 7, when the movable slider 20 moves back, the locking recess 143 is pulled back by means of the stopper ring 150, so that the rotating member 140 can be rotated.

Hereinafter, the operation of the automatic locking apparatus having the above structure will be described.

Figure 8:
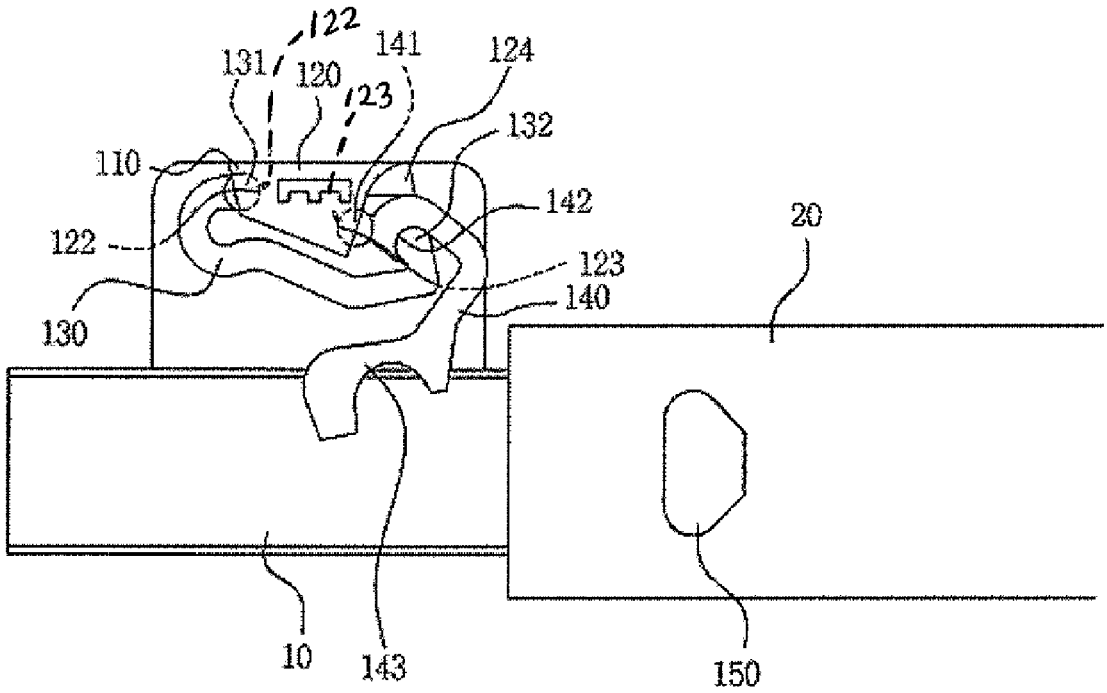
FIGS. 8 and 9 are views illustrating the operational state of an automatic locking apparatus according to an embodiment of the present invention.
Figure 9:
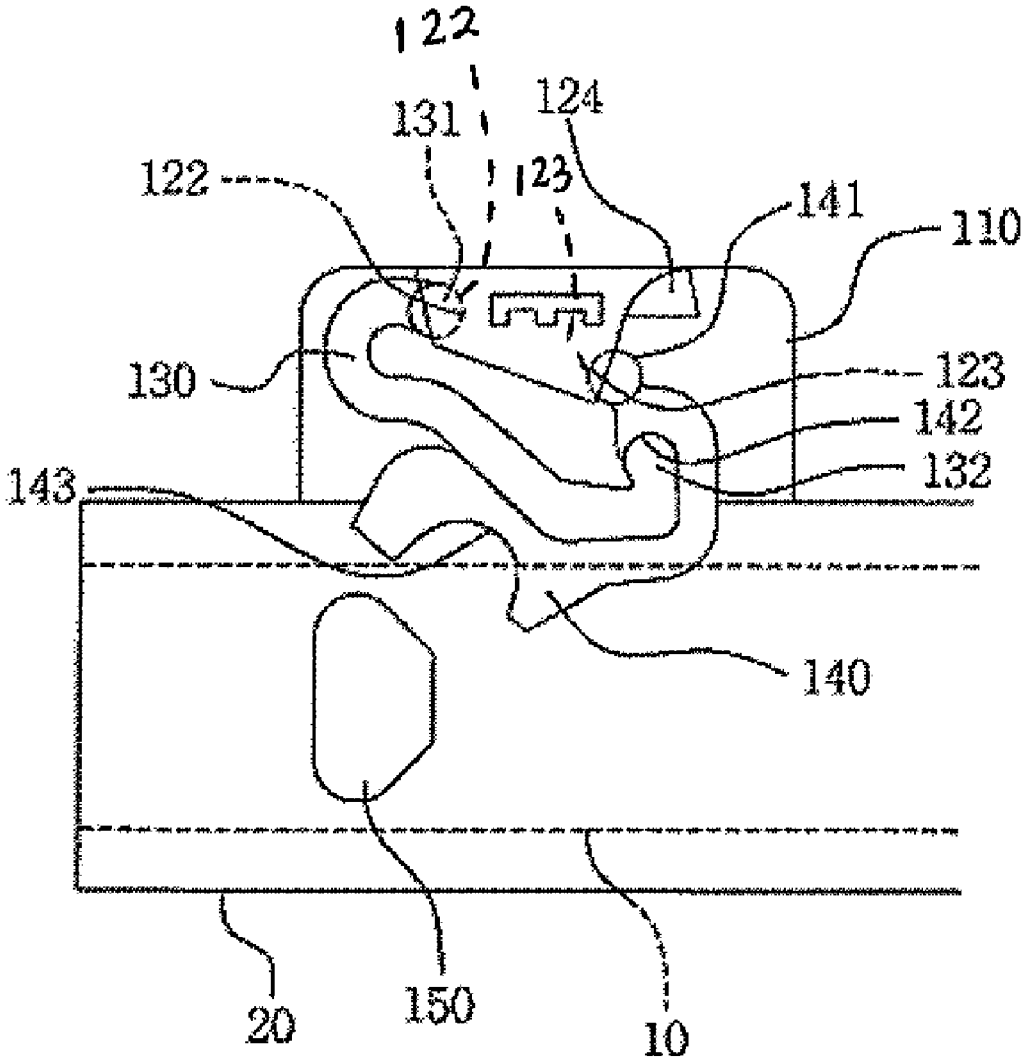

FIGS. 8 and 9 are views illustrating the operational state of the automatic locking apparatus 100 according to an embodiment of the present invention.

On the assumption that the fixing sliders 10 are fixedly attached to both inner side surfaces of the drawer receiving section and the movable sliders 20 are fixedly attached to both outer side surfaces of the drawer, as shown in FIGS. 8 and 9, the movable slider 20 moves back along the fixing slider 10 when the drawer is closed. When the drawer is almost closed, the stopper ring 150 of the movable slider 20 makes contact with the locking recess 143 of the rotating member 140.

In this state, if the user continuously pushes the drawer to close the drawer, the rotating member 140 is pivotably rotated. Since the upper end of the rotating member 140 is rotatably coupled with the other end of the body 120, the rotating member 140 can be easily rotated. However, if the second hinge 132 provided at the other side of the elastic member 130 is fixedly inserted into the third hinge groove 142 of the rotating member 140, the rotating member 140 cannot be easily rotated. Thus, if the user pushes the drawer by applying force to the drawer, the rotating member 140 may be slowly rotated. In this process, force hanging down the elastic member 130 is generated, so that the rotating member 140 is elastically moved.

The above operation is accomplished when the spacer protrusion 124 is not provided at the upper portion of the second hinge groove 123. According to the present invention, the spacer protrusion 124 is provided at the upper portion of the second hinge groove 123, so the rotating member 140 can be stopped at a return position thereof by means of the spacer protrusion 124. In this state, if the stopper ring 150 slightly touches the locking recess 143, the rotating member 140 is smoothly pulled back beyond the return position.

In this manner, if the stopper ring 150 that rotates the rotating member 140 moves beyond the first hinge 131, the second hinge 132 and the third hinge 141, the rotating member 140 is completely pulled back due to the elastic force of the elastic member 130. Herein, the reason of positioning the second hinge groove 123 below the first hinge groove 122 is as follows. If the third hinge groove 142 is positioned above an extension line between the first hinge groove 122 and the second hinge groove 123, a force that returns the rotating member 140 to its initial position will be generated. In addition, if the third hinge groove 142 is positioned below the extension line between the first hinge groove 122 and the second hinge groove 123, a force that pulls back the rotating member 140 in the reverse direction will be generated.

The above-described automatic locking apparatus 100 can prevent the drawer from moving back due to the tare of the drawer. That is, since the stopper ring 150 is locked with the rotating member 140, the movable slider 20 cannot be moved back caused by the tare thereof.

In contrast, when the user pulls the drawer to open the drawer, the movable slider 20 moves forward so that the stopper ring 150 makes contact with the locking recess 143 of the rotating member 140. In this state, if the user continuously pulls the drawer by applying force to the drawer, the rotating member 140 is pivotably rotated by means of the stopper ring 150. At this time, the rotating member 140 may not be easily rotated due to the elastic member 130. However, if the user pulls the drawer by applying relatively strong force to the drawer, the rotating member 140 is slowly rotated while overcoming the elastic force of the elastic member 130. In this state, if the third hinge groove 142 of the rotating member 140 is positioned above the extension line between the first and second hinge grooves 122 and 123, the rotating member 140 returns to its initial position by means of the elastic force of the elastic member 130.

As described above, according to the automatic locking device used in the guide rail for the drawer of the present invention, the drawer may not be opened caused by the tare thereof after the drawer has been closed, if the user does not intentionally pull the drawer with strong force to open the drawer. Accordingly, the drawer can be prevented from being separated from the desk or the cabinet even if vibration or external impact is applied thereto. In addition, the drawer can be prevented from being separated from the desk or the cabinet, even if the desk is inclined or turned over when the user moves the desk.

Furthermore, according to the present invention, the rotating member is maintained at the return position thereof by means of the spacer protrusion, so the rotating member can be smoothly rotated or pulled back even if little force is applied thereto.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. An automatic locking apparatus used in a guide rail for a drawer, in which the guide rail includes fixing sliders attached to both inner side surfaces of a drawer receiving section, the fixing sliders having a first convey slot formed on outer portions of upper and lower bending sections of the fixing sliders, movable sliders attached to both outer side surfaces of the drawer so as to move along the fixing sliders, the movable sliders being sized to receive the fixing sliders therein and having a second convey slot formed on inner portions of upper and lower bending sections of the movable slider overlying the first convey slots of the fixing sliders, and a stopper ring provided at a front outer surface of an end portion of the movable slider, the automatic locking apparatus being provided at an end portion of the fixing slider so as to incorporate with the stopper ring, the automatic locking apparatus comprising:

a fixing plate integrally formed at an upper surface of an end portion of the fixing slider;

the fixing plate having a mounting member provided at an upper surface of the fixing plate while protruding toward, but spaced above the movable slider;

a body being formed at a center thereof with a coupling hole so as to be coupled with the mounting member, and positioned above the movable slider, first and second hinge grooves having semi-cylindrical shapes being formed at first and second end portions of the body, and the second hinge groove being positioned lower than the first hinge groove;

an elastic member, in which first and second hinges are integrally formed at both side ends of the elastic member, and the first hinge is rotatably inserted into the first hinge groove so that the elastic member is rotatably coupled with the body; and a rotating member, in which a third hinge having a cylindrical shape corresponding to the second hinge groove is provided at one end of an upper portion of the rotating member, a third hinge groove corresponding to the second hinge is formed at a rear portion of the third hinge, the third hinge is rotatably inserted into the second hinge groove, the second hinge is inserted into the third hinge groove, and a locking recess making contact with the stopper ring is provided at a lower portion of the rotating member which overlies the movable slider such that the locking recess is positioned in front of the front outer surface of the movable slider when the movable slider is moved to position the stopper ring below the body.

2. The automatic locking apparatus of claim 1, further including a spacer protrusion carried on the body and engagable with the rotating member when the rotating member is moved to a non-locking position by the body.

3. The automatic locking apparatus of claim 2, wherein the spacer protrusion is positioned above the second hinge groove in the body.

* * * * *